US008585430B1

(12) United States Patent
Larner et al.

(10) Patent No.: US 8,585,430 B1
(45) Date of Patent: Nov. 19, 2013

(54) CONNECTOR WITH A SEVERING DEVICE AND WIRE TAPS

(75) Inventors: Daniel Lynn Larner, San Jose, CA (US); Ryan Joseph Andrade, San Jose, CA (US)

(73) Assignee: Google Inc., Mountain View, CA (US)

( * ) Notice: Subject to any disclaimer, the term of this patent is extended or adjusted under 35 U.S.C. 154(b) by 12 days.

(21) Appl. No.: 13/440,124

(22) Filed: Apr. 5, 2012

(51) Int. Cl.
*H01R 4/24* (2006.01)

(52) U.S. Cl.
USPC ..... 439/391

(58) Field of Classification Search
USPC ..... 439/391–410
See application file for complete search history.

(56) References Cited

U.S. PATENT DOCUMENTS

| | | | | |
|---|---|---|---|---|
| 4,822,298 | A * | 4/1989 | Gerke et al. | 439/402 |
| 5,393,932 | A | 2/1995 | Young et al. | |
| 5,433,625 | A | 7/1995 | Tsuji et al. | |
| 6,250,960 | B1 * | 6/2001 | Youtsey | 439/578 |
| 6,513,215 | B2 * | 2/2003 | Imaizumi | 29/33 M |
| 6,640,425 | B1 | 11/2003 | Suzuki | |
| 6,910,912 | B2 * | 6/2005 | Hung | 439/404 |
| 7,070,445 | B2 | 7/2006 | Shah et al. | |
| 7,234,961 | B2 * | 6/2007 | Arlitt et al. | 439/410 |
| 7,867,013 | B2 * | 1/2011 | Cox et al. | 439/404 |
| 7,902,288 | B2 | 3/2011 | Dower | |
| 8,062,056 | B2 * | 11/2011 | Lee | 439/395 |
| 2012/0021636 | A1 * | 1/2012 | Debenedictis et al. | 439/391 |

* cited by examiner

*Primary Examiner* — Chandrika Prasad
(74) *Attorney, Agent, or Firm* — Lerner, David, Littenberg, Krumholz & Mentlik, LLP

(57) ABSTRACT

Aspects of the disclosure relate generally to a connector including a housing with a severing device and a pair of wire taps built into the housing. For example, the severing device may sever the electrical connection along one or more wires placed inside the connector. The pair of wire taps may patch into the severed ends of the wires, intercepting any signal transmitted through the wires, and patching any signal transmitted along the wire tap into the severed wires. The wire taps may further be connected to an intermediate device, placing the intermediate device in series with the ends of the severed wire. The connector may also include a switching device between the first and second wire taps. When the switching device is closed, the switching device may directly connect the wire taps, shorting out the intermediate device and effectively reestablishing the direct electrical connection between the severed wire ends.

20 Claims, 8 Drawing Sheets

100

200

200

200

200

100

900

CONNECTOR WITH A SEVERING DEVICE AND WIRE TAPS

BACKGROUND

Signal patching allows for placing a device in series with a wire. This allows the patched device to override and patch signals into the wire, thereby controlling other objects or devices connected to the wire.

In order to patch a device into a preexisting wire, one must cut the wire, strip both sides of the cut wire, crimp pins onto each side of the cut wire, and connect the device to the pins. This process is manual, laborious, and time consuming. Further, points where the wire is cut and subsequently reconnected may constitute single points of failure for the whole system. Moreover, often times every wire in a bundle of wires or in a multi-wire cable will have to be cut just to patch into one or two of the wires.

SUMMARY

One aspect of the disclosure provides a connector for placing a device in connection with a first device and a second device. The first device and second device may be coupled via at least one wire. The connector may comprise a housing comprising an upper housing portion and a lower housing portion. Accordingly, the housing may be sized to encase a portion of the wire. The connector may also comprise a cavity between the upper housing portion and the lower housing portion. The connector may also comprise a severing device affixed to an interior wall of the housing and occupying a space within the cavity. The severing device may be adapted to sever the wire, thereby producing a first wire end and a second wire end. The connector may also comprise a first wire tap affixed to an interior wall of the housing and occupying a space within the cavity. The first wire tap may be adapted to be electrically coupled to the first wire end. The connector may also comprise a second wire tap affixed to an interior wall of the housing and occupying a space within the cavity. The second wire tap may be adapted to be electrically coupled to the second wire end. The first wire tap and the second wire tap may be adapted to be coupled to a third device.

According to one aspect, the connector may also comprise a switching device electrically coupled between the first wire tap and the second wire tap. The switching device may have a first state in which an electrical connection between the first and second wire taps is completed, and a second state in which the electrical connection between the first and second wire taps is open.

Another aspect of the disclosure provides a system, comprising a transmitting device configured for transmitting electrical signals, a receiving device configured for receiving electrical signals, and at least one wire for transmitting electrical signals between the transmitting device and the receiving device. The system may also comprise an intermediate device having an input port and an output port. The system may also comprise a connector for placing the intermediate device in connection with the transmitting device and the receiving device. The connector may comprise a housing comprising an upper housing portion and a lower housing portion. Accordingly, the housing may be sized to encase a portion of the wire. The connector may also comprise a cavity between the upper housing portion and the lower housing portion, a first lead wire port providing a first opening between an exterior surface of the upper housing portion and the cavity, and a second lead wire port providing a second opening between an exterior surface of the upper housing portion and the cavity. The first lead wire port may be adapted to receive a first lead wire of the intermediate device, and the second lead wire port may be adapted to receive a second lead wire of the intermediate device. The connector may also comprise a severing device affixed to an interior wall of the housing and occupying a space within the cavity. The severing device may be adapted to sever the wire, thereby producing a first wire end and a second wire end. The connector may also comprise a first wire tap affixed to an interior wall of the housing and occupying a space within the cavity. The first wire tap may be adapted to be electrically coupled to the first wire end. The connector may also comprise a second wire tap affixed to an interior wall of the housing and occupying a space within the cavity. The second wire tap may be adapted to be electrically coupled to the second wire end.

A further aspect of the disclosure provides a method for placing an intermediate device in series with at least one wire. The method may comprise placing the wire inside a connector, the connector comprising a housing, a cavity within the housing, a severing device attached to the housing within the cavity, a first wire tap, and a second wire tap. The method may also comprise closing the connector, encasing a portion of the wire within the cavity. Upon closing the connector, the connector may sever the wire, thereby producing a first wire end and second wire end, electrically couple the first wire tap to the first wire end, and electrically couple the second wire tap to the second wire end. The method may also comprise electrically coupling an input port of the intermediate device to the input wire tap, and electrically coupling an output port of the intermediate device to the output wire tap.

DETAILED DESCRIPTION

Aspects, features and advantages of the disclosure will be appreciated when considered with reference to the following description of embodiments and accompanying figures. The same reference numbers in different drawings may identify the same or similar elements. Furthermore, the following description is not limiting; the scope of the present disclosure is defined by the appended claims and equivalents.

Figure 1:
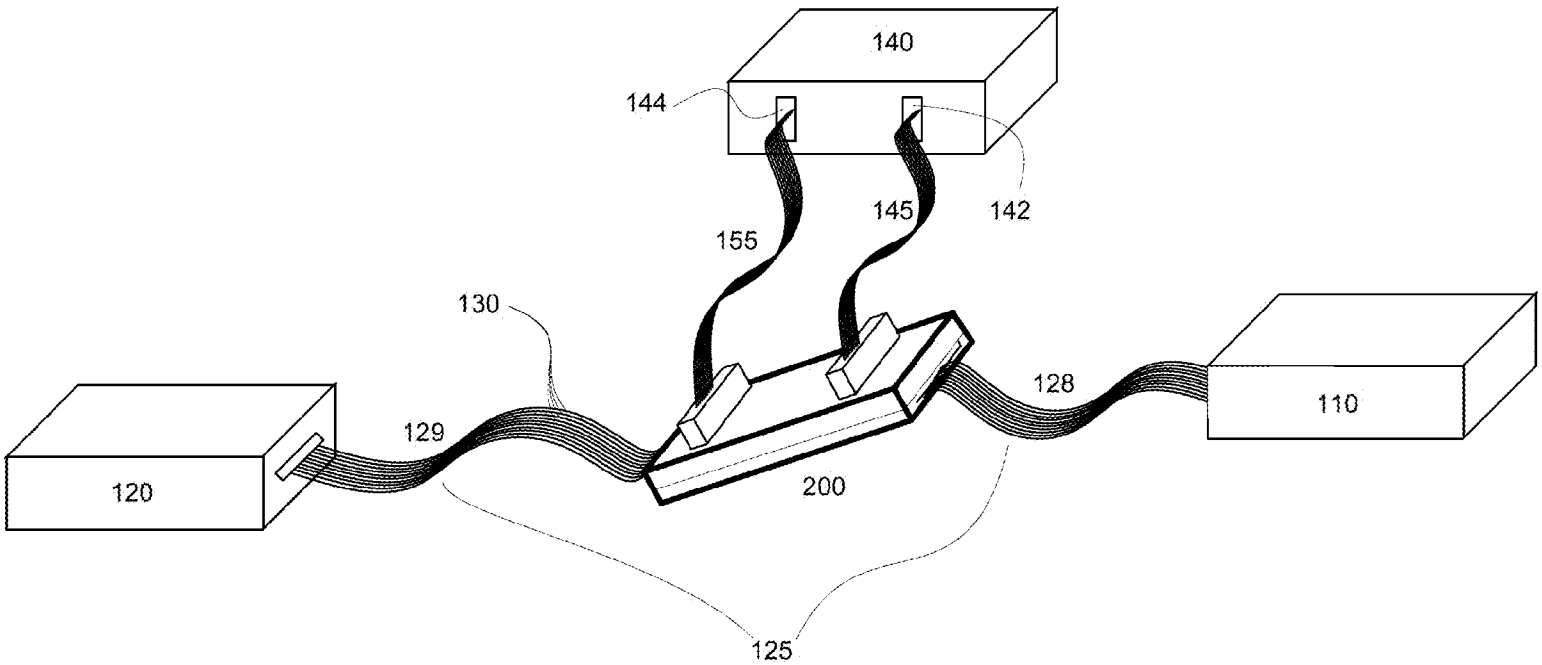
FIG. 1 is a functional diagram of a system in accordance with aspects of the disclosure.

FIG. 1 is a functional diagram of a system 100 in accordance with aspects of the disclosure. The system 100 may include a first device 110 and a second device 120, such as a transmitting device 110 and a receiving device 120 in an autonomous vehicle. For example, the transmitting device 110 may be a user input associated with a system of the autonomous vehicle, such as an accelerator pedal for controlling the acceleration system of the vehicle, a braking pedal for controlling the braking system of the vehicle, a steering wheel for controlling the steering system of the vehicle, etc. The receiving device 120 may be a control associated with the same system of the autonomous vehicle as the transmitting device 110, such an acceleration control, a deceleration control, or a steering control.

The transmitting device may transmit one or more signals to the receiving device 120 via one or more wires, such as a wire cable 125. The wire cable 125 may include any number of discrete wires 130. For example, the wire cable 125 may be a single wire, a multi-wire ribbon cable including 20 or more discrete wires, a fiber-optic cable, or any other type of wire capable of carrying a signal.

The system 100 may also include an intermediate device 140, such as an autonomous override device for controlling an autonomous vehicle. The intermediate device 140 may be coupled to each of the transmitting device 110 and the receiving device 120 through a connector 200. The intermediate device 140 may include an input port 142 for receiving signals sent by the transmitting device 110, and an output port 144 for sending signals to the receiving device 120. For example, the autonomous override device 140 may receive an input signal from the accelerator pedal, braking pedal, or steering wheel of the vehicle, and may transmit an output signal (e.g., the received signal, a modified version of the received signal, a newly generated signal) to the accelerator, brake, or steering column of the vehicle. According to one aspect, the input port 142 and output port 144 may be a single port, for example, coupled to the connector via a coaxial cable.

As described herein, the connector 200 may splice the wire cable 125 between the transmitting device 110 and the receiving device 120, form connections to each of a first wire end 128 and a second wire end 129 of the spliced wire cable 125, and couple the spliced wire ends 128/129 to an input port 142 and output port 144, respectively, of the intermediate device 140. In one example, the connector 200 may form a connection to the first wire end 128 of the wire cable 125 and relay signals transmitted from the transmitting device 110 via the first wire end 128 to the input port 142 of the intermediate device 140 via an input lead wire 145. In another example, the connector 200 may form a connection to the second wire end 129 of the wire cable and relay signals transmitted from the intermediate device 140 via an output lead wire 155 to the receiving device 120 via the second wire end 129. Using the connector 200 to couple the intermediate device 140 to the transmitting and receiving devices 110/120 may increase the efficiency and streamline the process of patching a device in series with a preexisting wire considerably reducing the time and labor normally involved.

Figure 2:
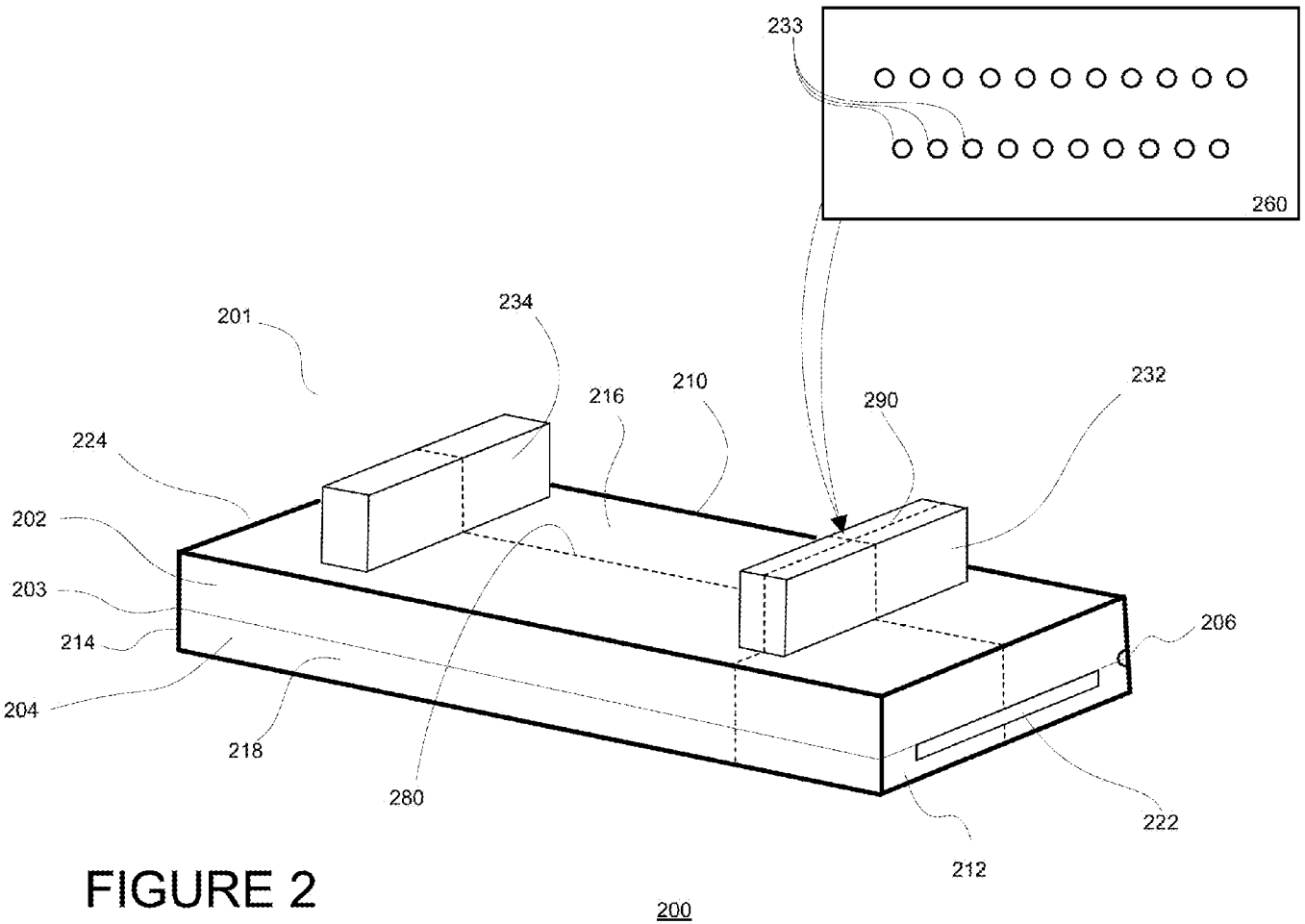
FIG. 2 is a perspective view of an example connector in a first configuration, along with an exploded top-down view of a portion of the connector, in accordance with aspects of the disclosure.
Figure 3:
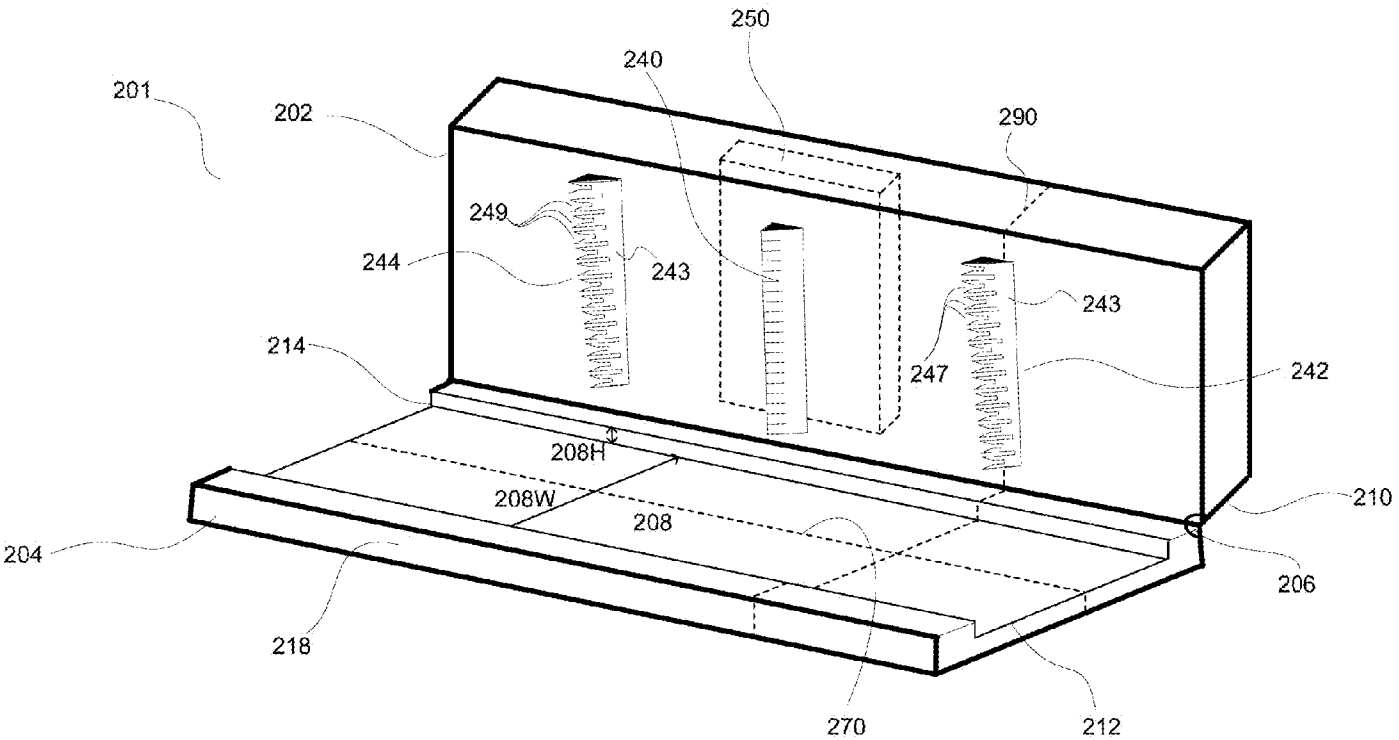
FIG. 3 is a perspective view of the example connector of FIG. 2 in a second configuration in accordance with aspects of the disclosure.

As shown in FIGS. 2 and 3, the connector 200 may include a housing 201, which may be made of a firm, resiliently flexible, plastic insulating material, such as polypropylene. The housing 201 may include an upper housing 202, and a lower housing 204. In the example of FIGS. 2 and 3, the upper housing 202 and lower housing 204 may be connected by hinges 206 along a back wall 210 of the connector 200. In other examples, the upper housing 202 and lower housing 204 may be connected by a post, cup, or other guiding feature. The upper housing 202 and lower housing 204 may touch along a portion of each of the back wall 210, front wall 218, input sidewall 212, and output sidewall 214, at a border 203. As described in greater detail below, portions of the upper housing 202 and lower housing 204 may be separated on the interior of the connector 200 by hollowing out a portion of the interior of the connector 200 (such as a cavity 208 shown below in connection to FIG. 3).

The connector 200 may also include various holes and/or apertures bridging the exterior and the interior of the connector 200. For example, the connector 200 may include a transmitting wire port 222 and a receiving wire port 224, enabling the wire 125 to access the interior cavity 208 of the connector. As a further example, the connector 200 may include a lead wire input port 232 and a lead wire output port 234 adapted to receive lead wires 145, 155 (e.g., coupled to the input port 142 and output port 144 of the intermediate device).

The transmitting and receiving wire ports 224 may each provide an opening between the exterior and the interior of the connector 200 (e.g., on the input sidewall 212 and the output sidewall 214, respectively). In this regard, a wire cable 125 may be inserted through the transmitting wire port 222, pass through the hollowed out portion of the interior of the connector 200, and exit out the receiving wire port 224. In some examples, the dimensions of the transmitting and receiving wire ports 222 and 224 may be slightly greater than the dimensions of the wire cable (e.g., the wire cable may fit through the port with little or no room to spare). Where the wire cable fits into the wire ports with some room to spare, all or some portion of the excess room may be filled with a sealant material, such as a grease or silicone gel, to seal out moisture from the interior of the connector 200 and to protect the components in the interior of the connector 200 against oxidation.

The lead wire input port 232 and output port 234 may provide one or more openings between the upper wall 216 and the interior of the connector 200. An exploded top-down view of an upper surface 260 of lead wire input port 232, which may be identical in appearance to the lead wire output port 234, is shown in FIG. 2. The upper surface 260 of the lead wire input port 232 may include one or more lead wire holes 233 capable of receiving a lead wire (e.g., the lead wire 145). For example, where the lead wire 145 comprises multiple wires (e.g., in a bundle), multiple lead wire holes 233 may be present and may each receive an individual wire of the bundle. In one example, the lead wire holes 233 may be arranged in a staggered, or zig-zag, pattern, such as in the arrangement in FIG. 2. In another example, the lead wire holes 233 may be aligned in a single row, or in any other configuration.

In the example where the upper housing 202 and lower housing 204 are connected by hinges 206, the connector 200 may be opened and closed along the rotational axis of the hinges 206. In other examples, where the upper housing 202 and lower housing 204 of the connector 200 are connected by a post, cup, or other guiding feature, the connector 200 may be opened and closed along the axis of the guiding feature. FIG. 2 is an example of the connector 200 while closed, showing portions of the exterior of the connector 200. FIG. 3 is an example of the connector 200 while open, showing portions of both the interior and exterior of the connector 200. As shown in the example of FIG. 3, while the connector is open, the upper housing 202 and lower housing 204 may touch only along the back wall 210, making the interior of the connector 200 accessible through the front wall 218, input sidewall 212, and output sidewall 214. In other examples, the upper housing 202 and lower housing 204 may separate entirely while the connector 200 is open, making the interior of the connector 200 accessible even through the back wall 210.

Turning to the interior of the connector 200 in FIG. 3, a portion of the housing 201 may be hollowed out to form the cavity 208 within the interior. The cavity 208 may extend from the transmitting wire port 222 to the receiving wire port 224. The cavity 208 may be of uniform width 208W and of uniform height 208H. In the example of FIG. 3, the cavity 208 is shaped to fit a planar multi-wire cable, such as the wire cable 125 of FIG. 1. In one example, the width 208W and height 208H may be slightly greater than the width and height of the wire cable (e.g., the wire cable fits into the cavity 208 with little or no room to spare). Where the wire cable fits into the cavity 208 with some room to spare, a portion of excess room may be filled with a sealant material, such as the sealant material described above.

The connector 200 may also include various components affixed within the interior of the housing 201. For example, the connector 200 may include a severing device 240, an input wire tap 242, an output wire tap 244, and a switching device 250 (encased within the upper housing 102).

The severing device 240 may be useful for interrupting the electrical connection along a wire cable placed inside the connector 200. The severing device 240 may be a blade, scissors, wire cutter, shear, heating implement, clamp, or other implement capable of interrupting the electrical conductivity along the wire cable 125. According to some aspects, the severing device 240 may include recesses along a cutting edge the severing device 240. The recesses may extend from the cutting edge of the severing device 240 towards the upper housing 202 of the connector 200, such that a portion of the cutting edge is removed. Moreover, the recesses may be selectively positioned so based on a positioning of wires to be severed and wires to be kept intact.

The input wire tap 242 and output wire tap 244 may each include a nonconductive post 243 and one or more pins 247, 249 affixed to the nonconductive post 243. The input wire tap 242 and output wire tap 244 may each be useful for tapping into a conductive core of the wire cable 125 placed inside the connector 200. For example, the pins 247/249 may be made from tin plated brass or another conductive metal. In one example, the tip of each pin may be a single point. In another example, the tip of each pin may include multiple points in a fork-shaped arrangement. Each of the points may be sharpened in order to effectively pierce through the insulation of the wire and form a contact with the wire's conductive core. The nonconductive post 243 may be made from a firm, resiliently flexible, plastic insulating material, such as polypropylene, to reinforce the pins 247, 249 and keep the pins 247, 249 properly aligned. In another example, the pins 247, 249 may be affixed directly to the upper housing. In such an example, the input wire tap 242 may consist only of the pins 247 and no additional material.

The switching device 250 may include one or more switches for controlling an electrical connection between the pins 247, 249 of the input wire tap 242 and the output wire tap 244. The switching device 250 is described in greater detail below with reference to FIG. 5.

Figure 4:
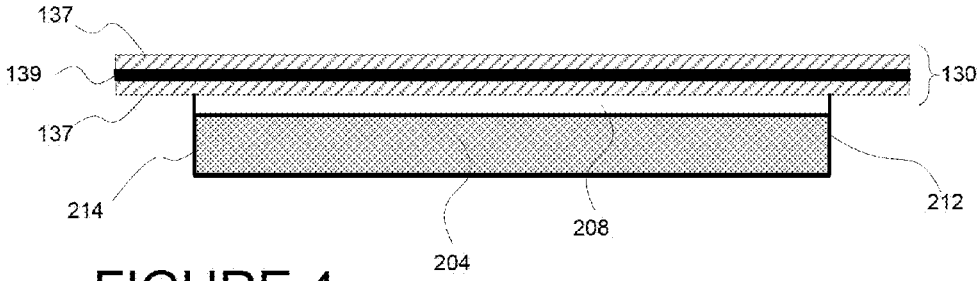
FIG. 4 is a partial cross sectional view of the connector of FIG. 2.

FIG. 4 is a cross-sectional view, along reference line 270 (shown in FIG. 3), of the connector 200 in the open configuration. Because FIG. 4 is a cross-sectional view, only the lower housing 202 of the connector and one wire 130 of a wire cable 125 are shown, as the upper housing of the connector 200 and the other wires of the wire cable 125 are not in line with the plane of reference line 270. The wire 130 may be positioned on top of the lower housing 204 while the connector 200 is open as a preliminary step to attaching the connector 200 across the wire 130. The wire 130 may include a conductive core 139 encased in insulation 137. The insulation 137 may enclose the conductive core 139 on all sides. For example, the insulation 137 may separate the conductive core 139 from the conductive core of each of the other wires in the wire cable 125.

Figure 5:
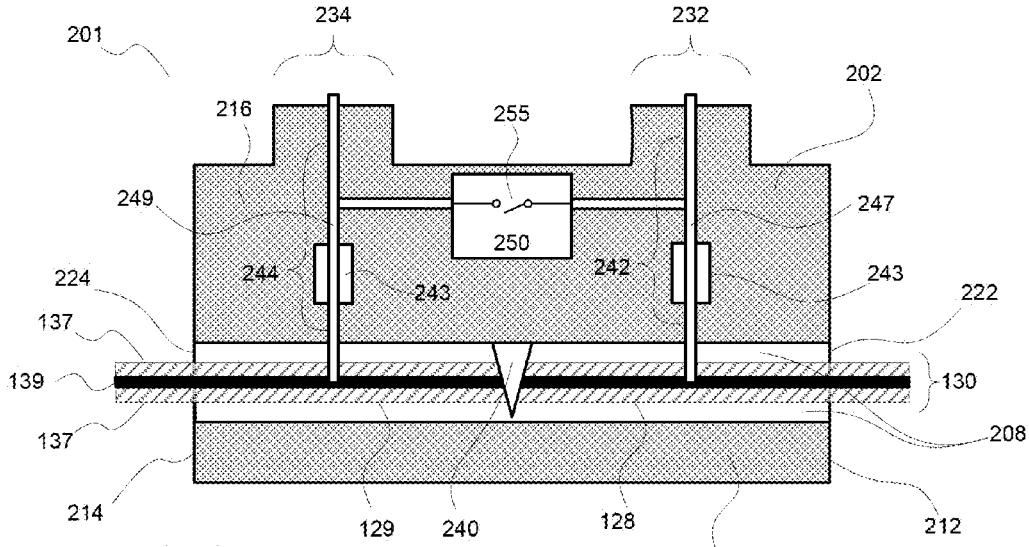
FIG. 5 is a partial cross sectional view of the connector of FIG. 3.

In the example of FIG. 5, the connector 200 is closed. The severing device 240, which may be affixed to the upper housing 202, occupies a portion of the cavity 208 between the input sidewall 212 and the output sidewall 214. As the severing device 240 is lowered into the cavity (upon closing the connector 200), the severing device 240 cuts through the wire 130, interrupting the electrical connection between a first wire end 128 and a second wire end 129 of the severed wire 130. In an example where a sealant is used to fill the remaining space of the cavity 208, as described above, the sealant may also be used to insulate the severed ends of the wire 130, to prevent the severed ends from twisting, or to provide relief against strain.

In the example of FIG. 5, the severing device 240 may sever each of the wires in the wire cable 125. Alternatively, where the severing device 240 includes one or more recesses, the severing device 240 may sever only a preselected subset of wires in the wire cable 125. For example, when the connector 200 is closed, the notches/grooves may align with wires to be kept intact, and the remaining wires may be severed.

The input and output wire taps 242 and 244 may be affixed to the interior wall of the upper housing 202 opposite the corresponding input and output ports 232 and 234. For example, the input wire tap 242 may occupy a portion of the cavity 208 containing the first wire end 128 of the severed wire 130, and the output wire tap 244 may occupy a portion of the cavity 208 containing the second wire end 129 of the severed wire 130.

Each of the wire taps 242 and 244 may include one or more pins. Because FIG. 5 is a cross-sectional view, only one input pin 247 and one output pin 249 are shown, as the other pins are not in line with the plane of reference line 280. The input pin 247 and output pin 249 are nonetheless representative of the other pins included in the input and output wire taps 242 and 244. As mentioned above, the tip of each pin may be sharpened in order to effectively pierce through the insulation 137 of the wire 130. When the connector 200 is closed, the pins 247/249 may pierce through the insulation 137 and electrically contact the conductive core 139 of the wire 130. For example, the input pin 247 may contact the conductive core 139 of the first wire end 128, and the output pin 249 may contact the conductive core of the second wire end 129. By contacting the conductive core 139 of the wire 130, a signal sent through the wire 130 may be intercepted by the contacting pin.

The switching device 250 may be encased in the upper housing 202 of the connector, between the input and output wire taps 242 and 244, and may electrically couple an input pin 247 of the input wire tap 242 to a corresponding output pin 249 of the output wire tap 244. For each pair of corresponding pins 247/249 electrically coupled by the switching device 250, the switching device may include a switch 255 coupled therebetween. The switch 255 may close or open a connection between the corresponding pins 247/249, establishing an open circuit or closed circuit, respectively. For example, when the switch 255 is closed, the switch 255 may establish a closed circuit between the pin 247 of the first wire tap 242 and a corresponding output pin 249 of the second wire tap 244. Thus, once the signal from the wire 130 is patched into and intercepted by the input pin 247, the signal may be relayed directly from the input pin 247 to the corresponding output pin 249 via the switching device 250, without traveling out of the connector 200. Conversely, when the switch 255 is open, the switch 255 may break the circuit between the corresponding pins 247/249. Thus, the signal may no longer be relayed directly from the input pin 247 to the corresponding output pin 249 via the switching device 250.

The switching device 250 may include a single switch 255 for establishing an open circuit or closed circuit between each pair of corresponding pins 247/249. In another example, the switching device 250 may include a separate switch 255 for each pair of corresponding pins 247/249. For example, a first switch coupled between a first pair of pins 247/249 may be open, while a second switch coupled between a second pair of pins 247/249 may be closed. In another example, the switching device 250 may include one or more switches 255 which may be coupled between any one of the input pins 247 to any one of the output pins 249, effectively crossing signals between the corresponding pairs of pins 247/249. In other words, the configuration of switches 255 in the switching device may include any possible permutation of electrical connections between the input and output pins 247/249.

Figure 6:
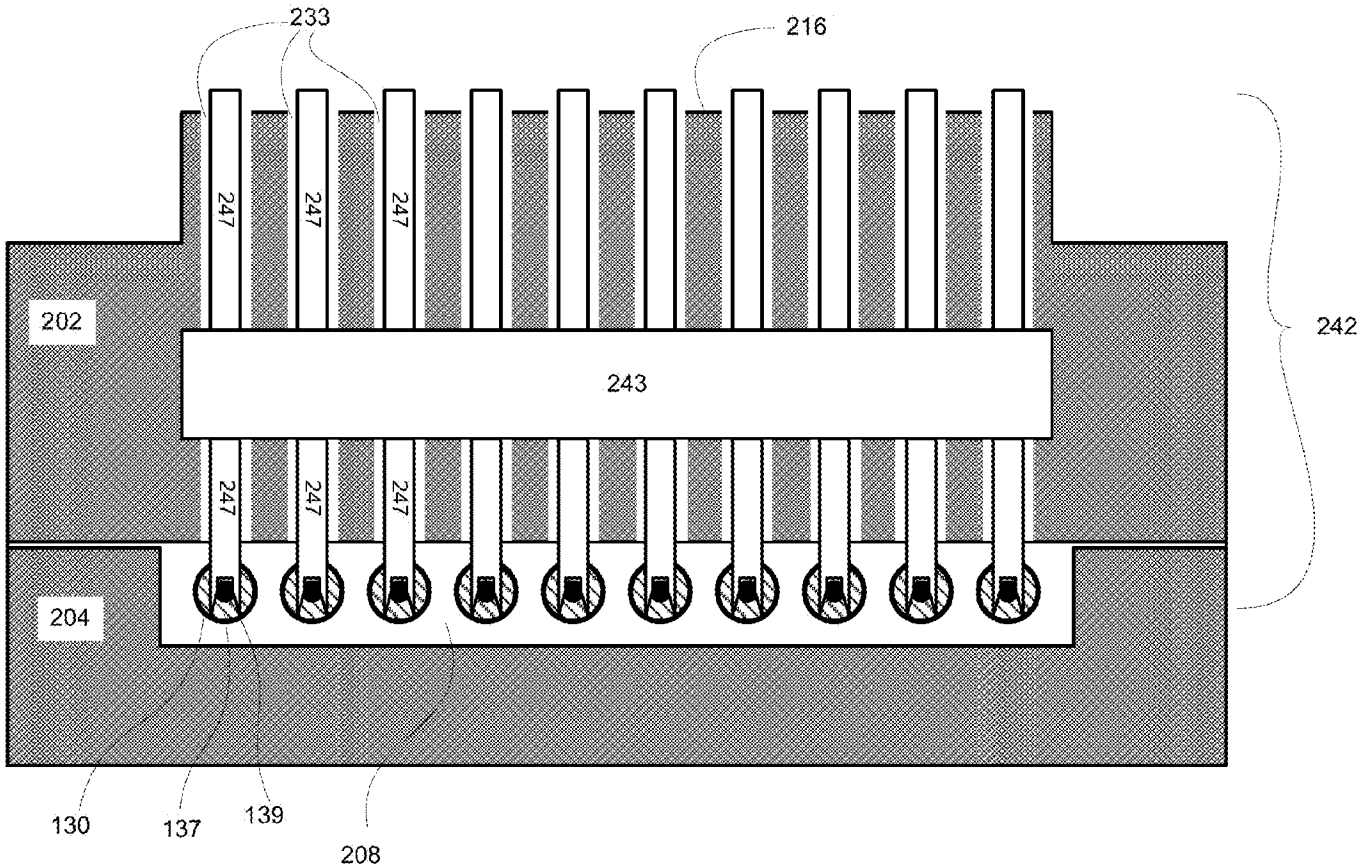
FIG. 6 is another partial cross sectional view of the connector of FIG. 3.

FIG. 6 illustrates a cross-sectional view of the connector 200 along reference line 290 (shown in FIG. 2). As shown, several discrete wires 130 included in the wire cable 125 may be positioned in the cavity 208 in relation to several input pins 247 included in the input wire tap 242. The input pins 247 may be arranged in a staggered pattern in order to align properly with the staggered arrangement of the lead wire holes 233. Therefore, only every alternating pin included in the input wire tap 242 is shown in FIG. 6, as the other pins are not in line with the plane of reference line 290. The input pins 247 may each pierce the insulation 137 of a discrete wire 130, contacting the conductive core 139 of the wire 130. As described above, by contacting the respective conductive cores 137 of the wires 130, signals sent through the wires 130 may be intercepted by the pins 247.

Each of the input pins 247 may extend from the cavity 208, through the nonconductive part 243, to the upper wall 216 of the connector 200 via an input lead wire hole 233. According to some aspects, each input pin 247 may extend beyond the upper wall 216 of the connector 200, as illustrated in FIG. 6. Alternatively, each input pin 247 may be recessed within the lead wire hole 233. The different configurations may accommodate different types of connectors for coupling the intermediate device. In either of these examples, when the lead wire for the intermediate device is coupled to the pin 247, a signal sent through a wire 130 and intercepted by the input pin 247 may be relayed through the pin 247 to the lead wire.

In the above example, the input wire tap 242 may include an input pin 247 for each of the wires 130 placed in the connector 200. In another example, the input wire tap 242 may include input pins 247 only for a preselected subset of the wires 130. This may be accomplished by removing pins 247 from the input wire tap 242 in locations where it is not desired that a wire be patched into, such as a wire that was not severed by the severing device 240. In this case, when the connector 200 is closed, the input pins 247 may align with and pierce the severed wires 130, while the rest of the wires 130 remain intact.

Although the output wire tap 244 and the output pins 249 are not shown, they may be arranged similarly to the input wire tap 242 and input pins 247.

Figure 7:
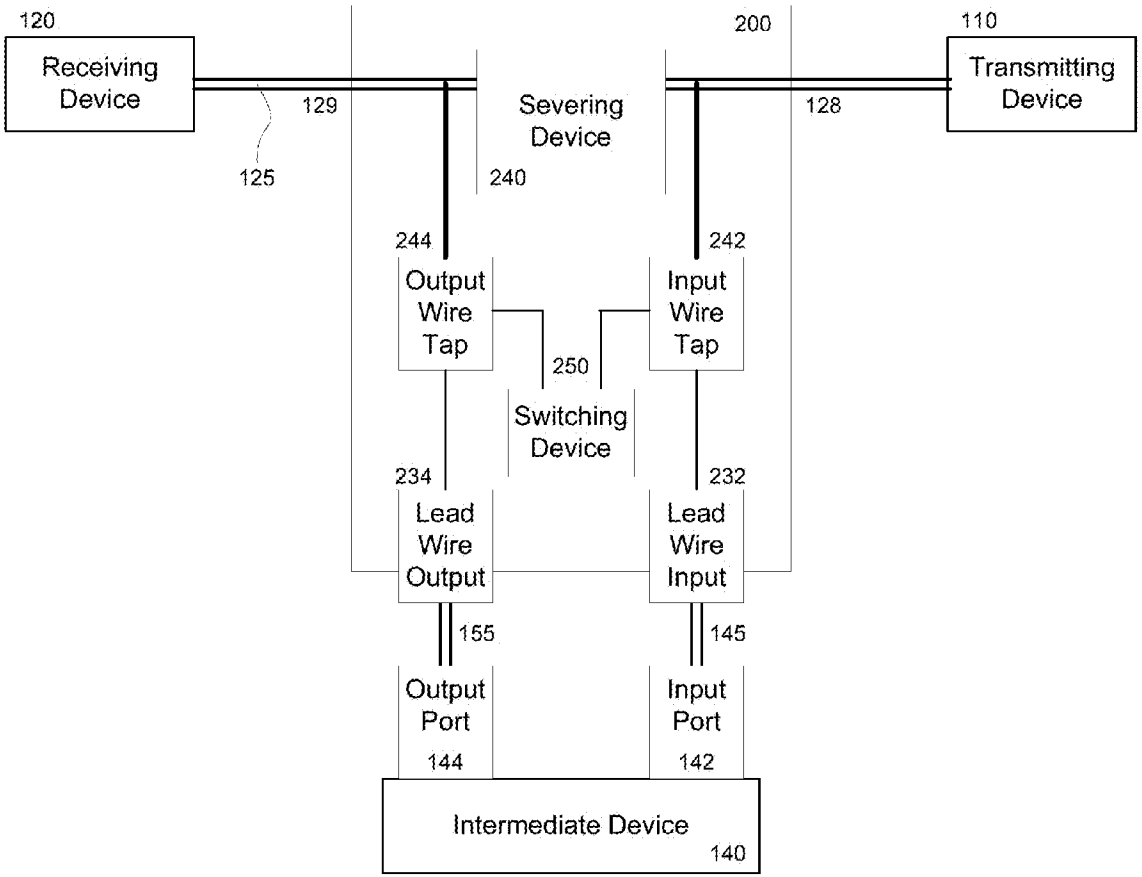
FIG. 7 is a functional diagram of a system in accordance with aspects of the disclosure.

FIG. 7 is a functional diagram of the system 100 depicted in FIG. 1. As described above, the wire cable 125 provides a direct connection for transmitting electrical signals from the transmitting device 110 to the receiving device 120. The severing device 240 of the connector 200 may interrupt this direct connection, producing a first wire end 128 and a second wire end 129 of the severed wire cable 125. Input and output wire taps 242 and 244 may tap into the input and output wire ends 128 and 129, respectively. Thus, a signal sent across the first wire end 128 may be intercepted by the input wire tap 242, while a signal sent to the output wire tap 244 may be patched into the second wire end 129.

According to one example, a signal sent by the transmitting device 110 along the first wire end 128 may be intercepted by the input wire tap 242 and relayed to the input lead wire 145, which is coupled to the input wire tap at the lead wire input port 232. From the input lead wire 145, the signal may be further relayed to the input port 142 of the intermediate device 140, and finally to the intermediate device 140. Thus, the intermediate device 140 may receive a signal transmitted by the transmitting device 110.

According to another example, a signal transmitted by the intermediate device 140 to the output lead wire 155 via the output port 144 may be relayed to the output wire tap 244, into which the output lead wire 155 is plugged at the lead wire output port 234. From the output wire tap 244, the signal may be further patched into the second wire end 129 and sent to the receiving device 120. Thus, the receiving device 120 may receive a signal transmitted by the intermediate device 140.

When connected to the transmitting device 110 and to the receiving device 120, the intermediate device 140 may intercept, modify, override, and/or relay the signals sent between the two devices. The intermediate device 140 may also generate its own signals to be transmitted to the receiving device 120.

In one example, the switching device 250 may control whether the intermediate device 140 receives signals from the transmitting device 110. When the switch 255 included in the switching device 250 is open, an open circuit may be established between the input and output wire taps 242 and 244. The open circuit across the switching device may have no effect on the connection between the wire taps 242 and 244 and the intermediate device 140. When the switch 255 is closed, a closed circuit may be established between the input and output wire taps 242 and 244. This may effectively short out the intermediate device 140, as any electrical signal relayed to the input wire tap 242 may be passed directly to the output wire tap 244 via the switching device 250. Furthermore, closing the switch 255 may reestablish the direct electrical connection between the transmitting device 110 and the receiving device 120, albeit through the switching device 250 instead of through the wire cable 125.

When the switch 255 is closed and the intermediate device 140 is effectively shorted out, the intermediate device 140 may still monitor signals sent between the transmitting device 110 and the receiving device 120. However, the intermediate device may no longer be capable of intercepting, overriding, or otherwise intervening with signals sent between the two devices, as the signals may be relayed through the switching device 250 without passing through the intermediate device 140.

Figure 8:
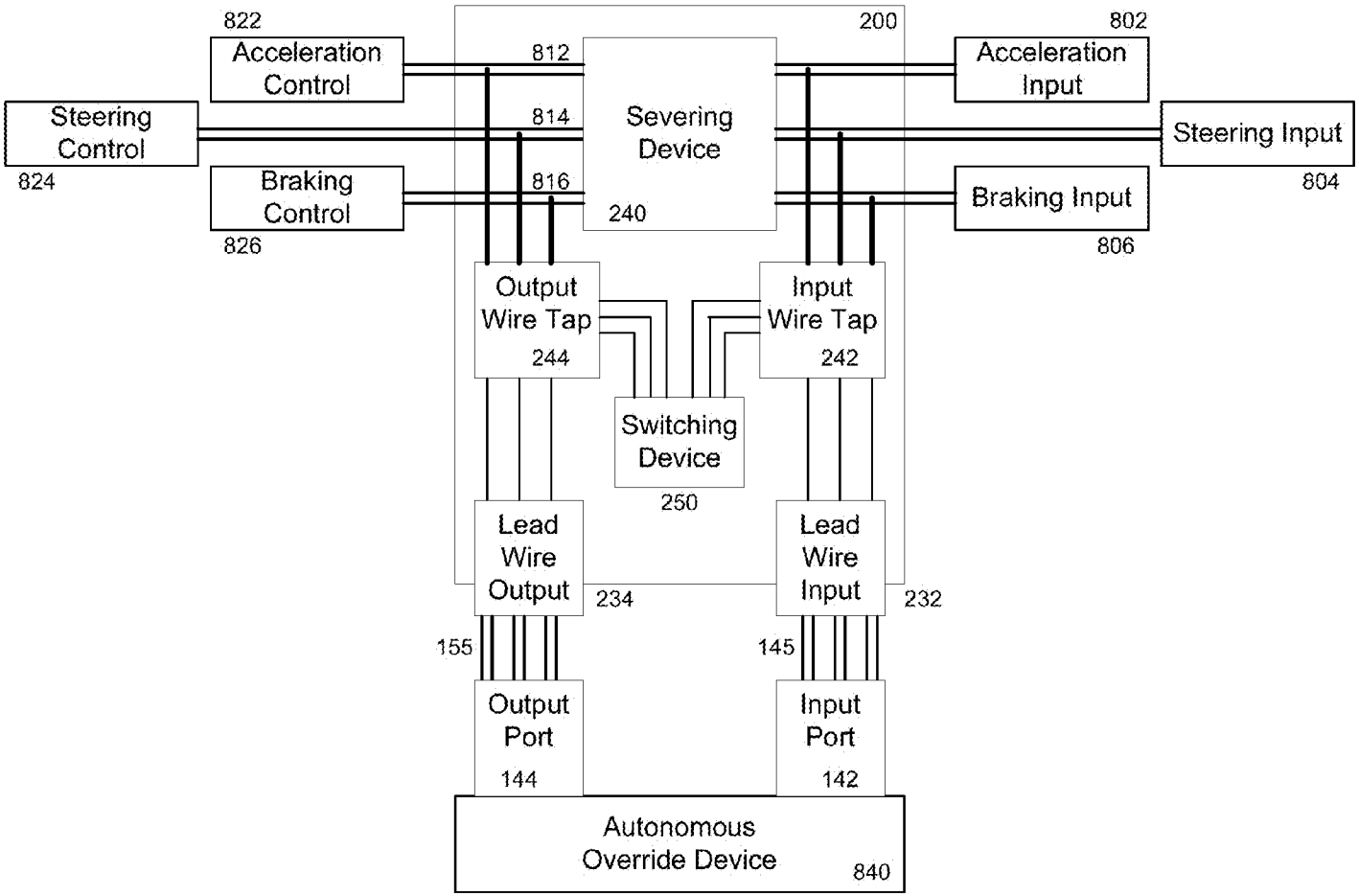
FIG. 8 is another functional diagram of a system in accordance with aspects of the disclosure.

As described in the general example above, the connector 200 may be used to connect devices capable of receiving and/or transmitting electrical signals. According to one specific example, the connector may be used to connect an autonomous override device, capable of maneuvering a vehicle autonomously or semi-autonomously, with the inputs and controls for various systems of the vehicle. For example, FIG. 8 is a functional block diagram of an autonomous vehicle system 800. The connector 200 is connected to several inputs and controls of a vehicle, such as an acceleration input 802, steering input 804, and braking input 806. The acceleration input 802 may be a user input associated with the acceleration system of the vehicle, and may be coupled to an acceleration control 822 (e.g., a control system associated with accelerating the vehicle) via an acceleration wire 812. The steering input 804 may be a user input associated with the steering system of the vehicle, and may be coupled to a steering control 824 via a steering wire 814. The braking input 806 may be coupled to a braking control 826 via a braking wire 816.

The connector 200, when attached across the wires 812-816, may interrupt the direct communication between the vehicle inputs 802-806 and their corresponding controls 822-826 using the severing device 240. The input and output wire taps 242 and 244 may patch into the acceleration, steering, and braking wires 812-816. Because the input wire tap 242 may be communicatively coupled to the lead wire input 232, the signals sent from the inputs 802-806 may be relayed to an autonomous override device 840 through the lead wire input port 232. Similarly, signals sent from the autonomous override device 840 (which may be the same as the input signals, modified versions of the input signals, newly generated signals, etc.) may be transmitted to the vehicle controls 822-826 through the lead wire output port 234.

In one example, a steering input 806 sent by a driver using the steering wheel of an autonomous vehicle may be intercepted by the autonomous override device 840. The intercepted steering signal may be modified by the autonomous driving system 840. For instance, if the autonomous vehicle detects a slight bend in the road ahead, the autonomous override device 840 may modify a steering signal corresponding to a sharp turn into a signal corresponding to a slight turn to keep the autonomous vehicle on a road. Alternatively, the intercepted steering signal may be replaced by a newly generated signal originating from the autonomous override device 840. For instance, the autonomous override device may maneuver the autonomous vehicle without any input from the driver, regardless of whether or not the driver turns the steering wheel 806.

The above example described a steering signal intercepted and subsequently modified or replaced by the autonomous override system 840. In other examples, the autonomous override system 840 may intercept, modify, and/or replace signals associated with other controls of the autonomous vehicle, such as the acceleration, braking, etc. Moreover, the inputs and controls coupled to the override device via the connector are not limited to those associated with acceleration, steering, and braking systems. The inputs and controls may also be associated with systems for controlling headlights (e.g., controlling high and low headlight beams), turn signals, brake signals, door locks, a car horn, audio/video functions, or other features of an autonomous vehicle.

The example systems described above may be constructed using the method described herein. It should be understood that the following operations do not have to be performed in the precise order described below. Rather, various operations can be handled in a different order, or simultaneously. Moreover, operations may be added or omitted.

Figure 9:
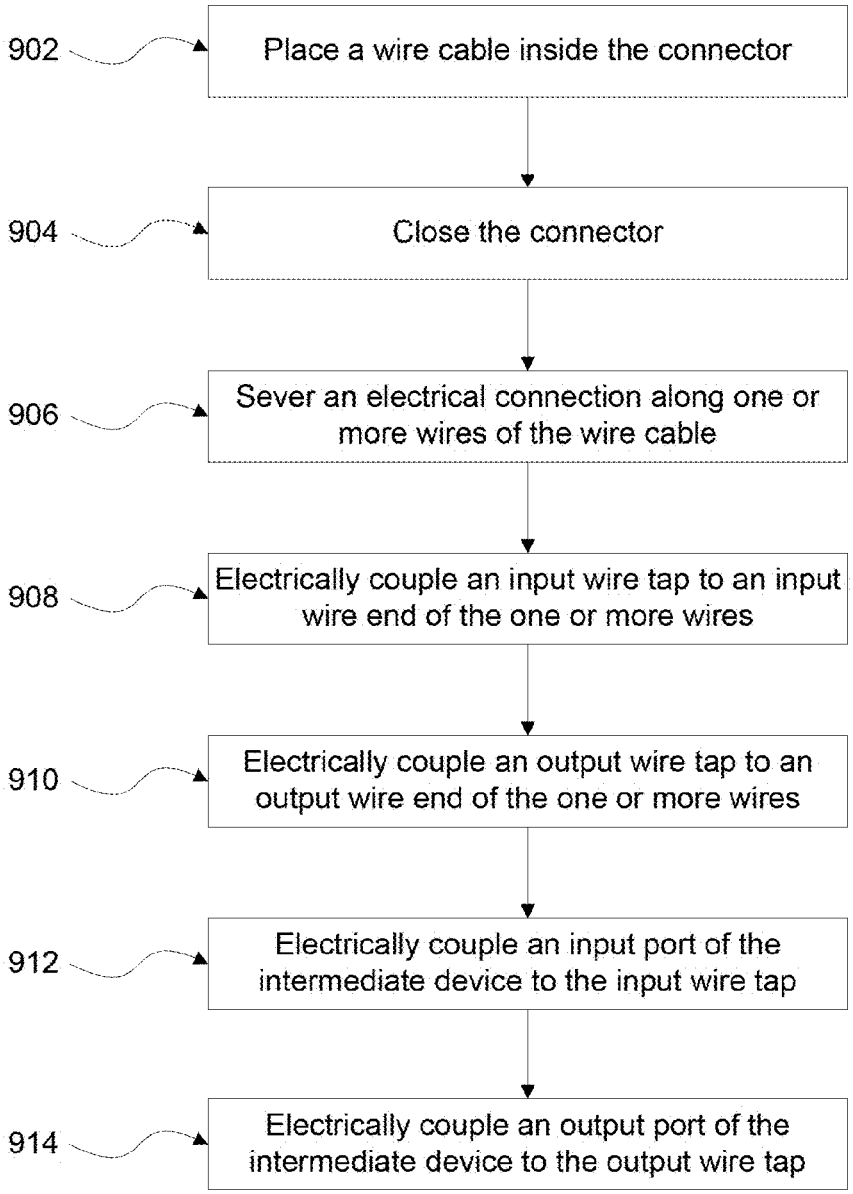
FIG. 9 is a flow diagram in accordance with aspects of the disclosure.

FIG. 9 illustrates an example flow chart 900 in accordance with some of the aspects described above. In block 902, the wire cable 125 may be placed inside the connector 200. For example, the wire cable may be placed in the cavity 208 of the connector 200. One end of the wire cable 125 may extend out the transmitting wire port 222 on the input sidewall 212 of the connector 200, and the opposite end of the wire cable 125 may extend out the receiving wire port 224 on the output sidewall 214 of the connector 200.

The wire cable 125 may fit through the transmitting and receiving wire ports 222 and 224, and through the cavity 208. Excess room between the wire and the ports may optionally be filled with a nonconductive sealant material to seal out moisture from the interior of the connector 200 and to protect the components in the interior of the connector 200 against oxidation.

In block 904, the connector 200 may be closed around the wire cable 125. For example, the upper housing 202 of connector may be clamped together with the lower housing 204. Closing the connector 200 may also involve locking the connector 200 to ensure that the connector 200 remains closed. In one example, a latch on the front wall of the housing 201 of the connector 200 may be fastened to ensure that the upper and lower housings 202 and 204 do not separate. In another example, the upper and lower housings 202 and 204 may be fastened together with clips. In another example, guiding features, such as the posts or cups described above, may hold the upper and lower housings 202 and 204 together.

In block 906, the severing device 240 may sever an electrical connection along one or more wires of the wire cable 125. For example, upon closing the connector 200, the severing device 240 may cut each of the one or more wires, producing a first wire end 128 and a second wire end 129 for each of the one or more wires.

In block 908, the input wire tap 242 may tap into the first wire end 128 of the one or more wires. In one example, an input pin 247 included in the input wire tap 242 may displace the insulation 137 and contact the conductive core 139 of the first wire end 128. In another example, tapping the input pin 247 of the input wire tap 242 into the one or more wires may involve crimping the input pin 247 to the first wire end 128 of the one or more wires.

In block 910, the output wire tap 244 may tap into the second wire end 129 of the one or more wires. In one example, an output pin 249 included in the output wire tap 244 may displace the insulation 137 and contact the conductive core 139 of the second wire end 128. In another example, tapping the output pin 249 into the one or more wires may involve crimping the output pin 249 to the second wire end 129 of the one or more wires.

In block 912, the input port 142 of the intermediate device 140 may be electrically coupled to the lead wire input port 232 of the connector 200 via the input lead 145. In one example, coupling the input port 142 to the lead wire input port 234 may involve crimping the input lead wires 145 to one or more input pins 247. In another example, the input lead wire 145 may be coupled directly to the input pins 247 without crimping. In yet another example, where the input pins 247 are recessed within the lead wire input port 232 and do not extend beyond the upper wall 210 of the connector 200, the input lead wire 145 may be coupled to the input pins 247 simply my plugging the input lead wire 145 into the one or more lead wire holes 233 of the lead wire input port 232.

In block 914, the output port 144 may be electrically coupled to the lead wire output port 234 of the connector 200 via the output lead wire 155. In one example, coupling the output port 144 to the lead wire output port 234 may involve crimping the output lead wire 155 to one or more output pins 249. In another example, the output lead wire 155 may be coupled directly to the output pins 249 without crimping. In yet another example, where the output pins 249 are recessed within the lead wire output port 234 and do not extend beyond the upper wall 216 of the connector 200, the output lead wire 155 may be coupled to the output pins simply by plugging the output lead wire 155 into the one or more lead wire holes 233 of the lead wire output port 234.

In the examples described above, the connector 200 receives, severs, and patches into a single wire cable 125. In other examples of the disclosure, the connector 200 may receive, sever, and patch into a bundle of separate wires. The separate wires may be of different shapes and lengths, so long as each wire is long enough to extend out both the input sidewall 212 and the output sidewall 214 when placed inside the connector 200. Placing separate wires into the connector 200 may allow a user of the connector to patch into several devices, each connected by separate wires, with a single motion of closing the connector 200. In this case, the intermediate device 140 may receive and transmit signals between multiple transmitting and receiving devices 110 and 120.

Also in the examples described above, the connector 200 connects to only one intermediate device via lead wires 144/155 connected to a lead wire input port 232 and a lead wire output port 234 of the connector. In other examples, separate wires may be connected to each of the holes 233 of the lead wire input and output ports. Connecting separate wires to the holes 233 of the lead wire input and output ports 232 and 234 may allow a user of the connector to connect several intermediate devices 140 to the connector (i.e., one intermediate device 140 for each pair of lead wires connected to pins 243 in a pair of corresponding holes 233). In this case, each of the separate intermediate devices may receive and transmit signals associated with a separate wire running between the transmitting device 110 and the receiving device 120.

The above-described technology may be advantageous in that it enables an intervening device to intercept signals between devices without the difficulty of manually cutting wire ends between the devices, crimping pins onto each side of the cut wire, and connecting the intervening device to the pins. Thus, intervening devices may be coupled in series with other devices with greater speed and reduced cost. Moreover, the intervening devices may be coupled to wires that are difficult or impossible to access, such as wires in a narrow space where it may be difficult or impossible to manually strip and crimp the wires. Moreover, because the connector may include a switching device, the direct electrical connection of the severed wire may be restored without manually disconnecting the intervening device and reconnecting the cut wire. Thus, for example, when the connector is implemented in an autonomous vehicle as described in FIG. 8, the driver may efficiently switch in and out of an autonomous driving mode.

As these and other variations and combinations of the features discussed above can be utilized without departing from the systems and methods as defined by the claims, the foregoing description of exemplary implementations should be taken by way of illustration rather than by way of limitation of the disclosure as defined by the claims. It will also be understood that the provision of examples (as well as clauses phrased as "such as," "e.g.", "including" and the like) should not be interpreted as limiting the disclosure to the specific examples; rather, the examples are intended to illustrate only some of many possible aspects.

The invention claimed is:

1. A connector for placing a device in connection with a first device and a second device, wherein the first and second devices are coupled via at least one wire, the connector comprising:

a housing comprising an upper housing portion and a lower housing portion, the housing sized to encase a portion of the wire;

a cavity between the upper housing portion and the lower housing portion;

a severing device affixed to an interior wall of the housing and occupying a space within the cavity, the severing device adapted to sever the wire, thereby producing a first wire end and a second wire end of the wire;

a first wire tap affixed to an interior wall of the housing and occupying a space within the cavity, the first wire tap adapted to be electrically coupled to the first wire end; and a second wire tap affixed to an interior wall of the housing and occupying a space within the cavity, the second wire tap adapted to be electrically coupled to the second wire end;

wherein the first wire tap and the second wire tap are adapted to be coupled to a third device.

2. The connector of claim 1, wherein:

the first wire tap comprises at least one first pin; and the second wire tap comprises at least one second pin.

3. The connector of claim 2, wherein the first and second pins are adapted to displace insulation surrounding the wire.

4. The connector of claim 2, wherein the first and second pins are adapted to electrically contact a conductive core of the wire.

5. The connector of claim 1, wherein the upper housing portion and the lower housing portion are attached by one or more hinges.

6. The connector of claim 1, wherein each of the upper housing portion and the lower housing portion comprises one or more guiding features, the guiding features adapted to connect the upper housing portion to the lower housing portion.

7. The connector of claim 1, wherein the cavity is shaped to accommodate a planar multi-wire cable.

8. The connector of claim 1, further comprising a sealant applied within a portion of the cavity.

9. The connector of claim 1, further comprising:

a first lead wire port providing a first opening between an exterior surface of the upper housing portion and the cavity, the first lead wire port adapted to receive a first lead wire; and a second lead wire port providing a second opening between an exterior surface of the upper housing portion and the cavity, the second lead wire port adapted to receive a second lead wire.

10. The connector of claim 9, wherein the first and the second opening each comprise a hole aligned with a portion of the wire.

11. The connector of claim 9, further comprising a plurality of first lead wire ports and second lead wire ports arranged in a staggered pattern.

12. The connector of claim 9, wherein:

the first wire tap comprises at least one first pin extending from the cavity up through at least a portion of the first opening; and the second wire tap comprises at least one second pin extending from the cavity up through at least a portion of the second opening.

13. The connector of claim 1, wherein the severing device comprises one of a blade, shear, heating implement, and clamp.

14. The connector of claim 1, wherein the severing device further includes one or more recesses, each recess extending from a cutting edge of the severing device toward the upper housing portion.

15. The connector of claim 1, further comprising a switching device electrically coupled between the first wire tap and the second wire tap, the switching device having a first state in which an electrical connection between the first and second wire taps is completed, and having a second state in which the electrical connection between the first and second wire taps is open.

16. A system, comprising:

a transmitting device configured for transmitting electrical signals;

a receiving device configured for receiving electrical signals;

at least one wire for transmitting electrical signals between the transmitting device and the receiving device;

an intermediate device having an input port and an output port;

a connector for placing the intermediate device in connection with the transmitting device and the receiving device, the connector comprising:

a housing comprising an upper housing portion and a lower housing portion, the housing sized to encase a portion of the wire;

a cavity between the upper housing portion and the lower housing portion;

a first lead wire port providing a first opening between an exterior surface of the upper housing portion and the cavity, the first lead wire port adapted to receive a first lead wire of the intermediate device;

a second lead wire port providing a second opening between an exterior surface of the upper housing portion and the cavity, the second lead wire port adapted to receive a second lead wire of the intermediate device;

a severing device affixed to an interior wall of the housing and occupying a space within the cavity, the severing device adapted to sever the wire, thereby producing a first wire end and a second wire end of the wire;

a first wire tap affixed on an interior wall of the housing and occupying a space within the cavity, the first wire tap adapted to be electrically coupled to the first wire end; and a second wire tap affixed to an interior wall of the housing and occupying a space within the cavity, the second wire tap adapted to be electrically coupled to the second wire end.

17. The system of claim 16, wherein the intermediate device is configured to modify a received electrical signal and to transmit the modified received electrical signal.

18. The system of claim 17, wherein the intermediate device is further configured to generate a new electrical signal and transmit the new electrical signal.

19. The system of claim 18, wherein the new electrical signal is transmitted in place of the received electrical signal.

20. The system of claim 16, wherein the intermediate device is an autonomous override device adapted to maneuver a vehicle autonomously or semi-autonomously.

* * * * *